US007497056B2

(12) United States Patent
Surowiecki

(10) Patent No.: US 7,497,056 B2
(45) Date of Patent: Mar. 3, 2009

(54) PREFORMED WALL PANEL

(76) Inventor: Matt F. Surowiecki, 10023 Martin Luther King Jr. Way S., Seattle, WA (US) 98178

( * ) Notice: Subject to any disclaimer, the term of this patent is extended or adjusted under 35 U.S.C. 154(b) by 310 days.

(21) Appl. No.: 11/451,157

(22) Filed: Jun. 12, 2006

(65) Prior Publication Data

US 2007/0283643 A1 Dec. 13, 2007

(51) Int. Cl.

| | |
|---|---|
| ***E04B 1/00*** | (2006.01) |
| ***E04B 5/00*** | (2006.01) |
| ***E04B 7/00*** | (2006.01) |
| ***E04C 2/32*** | (2006.01) |

(52) U.S. Cl. ..... 52/271; 52/783.11; 52/272; 52/261; 52/270; 52/284

(58) Field of Classification Search ..... 52/783.11, 52/783.19, 783.17, 798.1, 243, 336, 272, 52/284, 94, 95, 92.1, 262, 270, 478, 271; 428/167, 172

See application file for complete search history.

(56) References Cited

U.S. PATENT DOCUMENTS 4,161,087 A * 7/1979 Levesque ..... 52/62
4,197,687 A * 4/1980 Benoit ..... 52/309.9
4,722,158 A * 2/1988 Urdaneta ..... 52/316
6,023,806 A * 2/2000 Dumlao et al. ..... 14/73
6,324,812 B1 * 12/2001 Drya-Lisiecka ..... 52/783.11
6,467,118 B2 * 10/2002 Dumlao et al. ..... 14/73
6,789,367 B1 * 9/2004 Dando ..... 52/657
6,820,388 B2 * 11/2004 Newhouse et al. ..... 52/726.1
6,941,706 B2 * 9/2005 Austin et al. ..... 52/94
6,941,720 B2 * 9/2005 DeFord et al. ..... 52/783.14

* cited by examiner

*Primary Examiner*—Richard E Chilcot, Jr.
*Assistant Examiner*—Andrew J Triggs
(74) *Attorney, Agent, or Firm*—Delbert J. Barnard

(57) ABSTRACT

A floor/ceiling 10 has downwardly extending ribs (14) separated by downwardly opening channels (16). The floor/ceiling member (10) sits down on a horizontal header (32) that is on top of a building wall that extends perpendicular to the ribs (14) and the channels (16). A preformed wall panel (24) has a lower strip portion (26) that is connected to a side flange (36) on the header (32). Preformed wall panel (24) has upwardly directed peaks (28) and upwardly opening valleys (30). The peaks (28) are sized and shaped to snuggly fit within the ceiling channels (16). The valleys (30) are sized and shaped to snuggly receive the ribs (14) when the peaks (28) are in the channels (16). A continuous lower strip portion of the preformed wall panel (24) is connected to the flange (36) of the header (32), below the ribs (14). The peaks (28) extend into and block or close off the channel openings formed in and by the channel (16) above the web (38).

9 Claims, 3 Drawing Sheets

PREFORMED WALL PANEL

TECHNICAL FIELD

The present invention relates to wall covering for walls that extend perpendicular to the ribs and channels of a corrugated ceiling. More particularly, it relates to the provision of a preformed wall panel that is connectable to an upper portion of the wall and is adapted for blocking channel openings formed by the corrugated ceiling above the wall.

BACKGROUND OF THE INVENTION

A common building construction utilizes corrugated sheet metal members between floors. A layer of concrete is poured on top of the corrugated member to form a floor for the upper level. The ribs and channels on the under side of the corrugated member form a ceiling for the lower space. The corrugated sheet metal member may, for example, be eighteen gauge galvanized steel. The channels that are defined in the under side of the member are typically about three inches deep and either four or six inches wide. Some interior walls extend transversely across the ribs and channels of the ceiling. Tunnel openings having cross-sectional areas equal to the areas of the channels are formed above the top frame member (header) of the interior wall. These tunnel openings extend across the top of the wall, from one side to the other. A fire can travel through the tunnel openings unless they are closed off or blocked.

U.S. Pat. No. 5,913,788, granted Jun. 12, 1999, to Thomas R. Herren, discloses several ways of blocking the tunnel openings to prevent a fire from spreading from one side of the wall to the other side. There is a need for providing a better way of blocking the tunnel openings that is less time consuming and less labor intensive than the known ways of blocking the tunnel openings. The primary object of the present is to fill this need.

BRIEF SUMMARY OF THE INVENTION

A primary object of the present invention is to provide a preformed wall panel comprising an upper portion having upwardly directed peaks and upwardly opening valleys. The peaks are sized and shaped to closely conform to the shape of the channels in the corrugated ceiling and the valleys are sized and shaped to closely conform to the shape of the ribs that form the channels. The preformed wall panel has a lower portion below the peaks and valleys that is connected to the wall after the peaks are in the channels and the ribs are in the valleys.

In preferred form, the preformed wall panel is cut from a sheet of wallboard, also referred to as plasterboard. The preformed wall panel is secured to the upper portion of the wall. Then, larger sheets of wallboard are attached to the wall below the lower edge of the preformed wall panel.

The present invention also includes making the preformed wall panel from sheet metal alone, or from wallboard and sheet metal or dense fiberboard panels that have been bonded together.

Other objects, advantages and features of the invention will become apparent from the description of the illustrated embodiments, from the drawings, from the claims and from the principles that are embodied in this specific structures, compositions and method steps that have been illustrated and described.

BRIEF DESCRIPTION OF THE SEVERAL VIEWS OF THE DRAWINGS

In the drawing, like reference numerals are used to designate like parts throughout the several views, and.

DETAILED DESCRIPTION OF THE ILLUSTRATED EMBODIMENT

Figure 1:
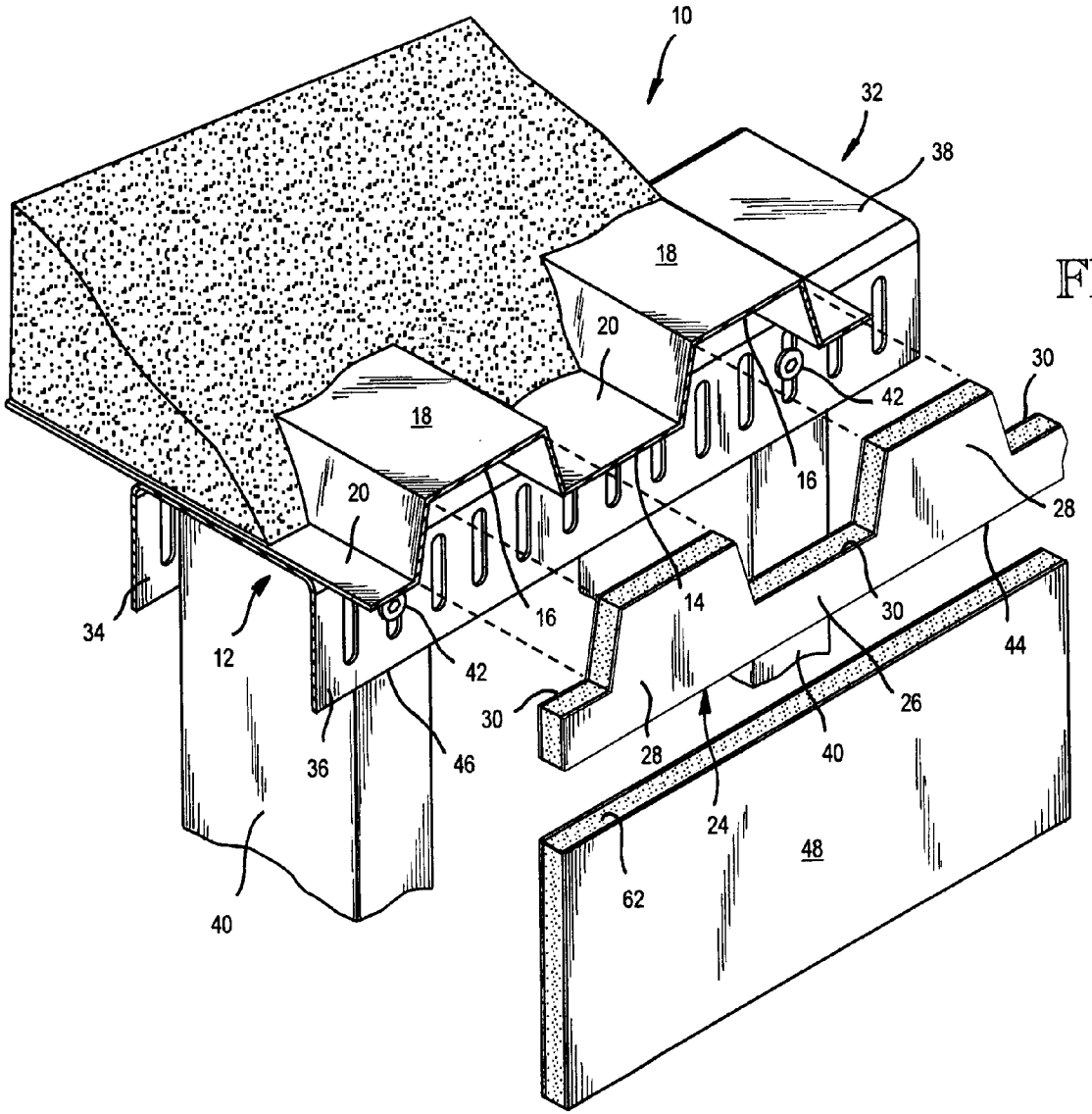
FIG. 1 is an exploded, fragmentary, pictorial view of a section of a ceiling/floor, a top portion of the wall framing, a section of a preformed wall panel incorporating the present invention, and a section of a larger wall panel that will be installed on the wall below the preformed panel section.

In FIG. 1, a ceiling/floor section is designated 10. It is made up of a corrugated sheet metal member 12. On its underside the member 12 is formed to include ribs 14 and channels 16 between the ribs 14. The ribs 14 are parallel and are laterally spaced apart. The channels 16 are parallel and they are positioned between the ribs 14. The ribs 14 extend downwardly and the channels 16 open downwardly between the ribs 14. On its upper side, the sheet metal member 12 has parallel, laterally spaced apart ribs 18 and parallel, laterally spaced apart channels 20 between the ribs 18. Concrete is poured in the channels 20 and over the tops of the ribs 18 to form a concrete floor 22 above the sheet metal member 12.

A preformed wall panel 24 includes a continuous strip lower portion 26 and an upper portion that is cut to form peaks 28 and valley 30. The peaks are sized and shaped to fit snuggly within the channels 16 in the floor/ceiling member 10. The valleys 30 are sized and shaped to snuggly receive the ribs 14. The continuous strip lower portion 26 is adapted to be connected to an upper portion of a wall that extends perpendicular to the floor/ceiling 12, 22.

The framing wall comprises upper and lower horizontal frame members interconnected by a plurality of laterally spaced apart vertical frame members. Typical examples of this wall is disclosed by U.S. Pat. No. 5,127,203, granted Jul. 7, 1992, to Robert F. Paquette, by U.S. Pat. No. 5,127,760, granted Jul. 7, 1992, to Todd A. Brady; and by U.S. Pat. No. 6,854,237, granted Feb. 15, 2005, to Malt F. Surowiecki. FIG. 1 shows the upper portion of the framing wall that is disclosed in U.S. Pat. No. 5,127,760. The upper horizontal framing member is commonly referred to as a header 32. It has a channel shape cross section and comprises a pair of laterally spaced apart flanges 42, 46 that are connected together at their tops by a web 38.

The upper end portions of the vertical members 40 (termed "studs") extend upwardly into the channel space of the header 32. Screw fasteners 42 extend through the flanges and screw into the studs 40. In this manner the studs 40 are connected to the header 32. At the lower end of the wall the lower ends of the studs 40 extend down into the channel space of a member like header 32 that is termed a "footer." Screws are also used to connect the footer to the lower ends of the studs 40. See FIG. 1 of U.S. Pat. No. 6,854,237.

The ribs 14 sit down on the web 38 of the header 32 and the channels 16 are above the web 38. Channel openings are formed above the header 32 from one side of the wall to the other.

In the embodiment of FIG. 1, the peaks 28 project upwardly into the channels 16. Peaks 28 are of a size and shape that closely conforms to the size and shape of the cross section of the channels 16. As a result, when the peaks 28 are in the channels 16, they substantially close off or block the end of the tunnel openings on their side of the wall. In this embodiment, the lower strip portion 26 of the preformed wall panel (h2) 24 is shorter than the flange 36 of the header 32. As a result, the preformed wall panel 24 has a lower edge 44 that is spaced above the lower edge 46 of the flange 36 of the header 32. After panel 24 is installed, a larger panel 48 is connected to the wall below it. Panel 48 has an upper edge 50 that is moved up substantially against lower edge 44 of panel 24. A marginal upper edge portion of panel 48 is positioned against the flange 36 below the panel member 24. As a result, the lower portion of flange 36 backs up the upper edge portion of panel 48.

Herein, the term "preformed" means that the panel member 24 is manufactured in a factory and then delivered to the job site. At the job site, the worker does not have to cut the peaks and valleys 28, 30 but rather only has to lift the preformed members 24 into place and then screw them to the wall framing. This can be done quite easily and quickly.

Figure 2:
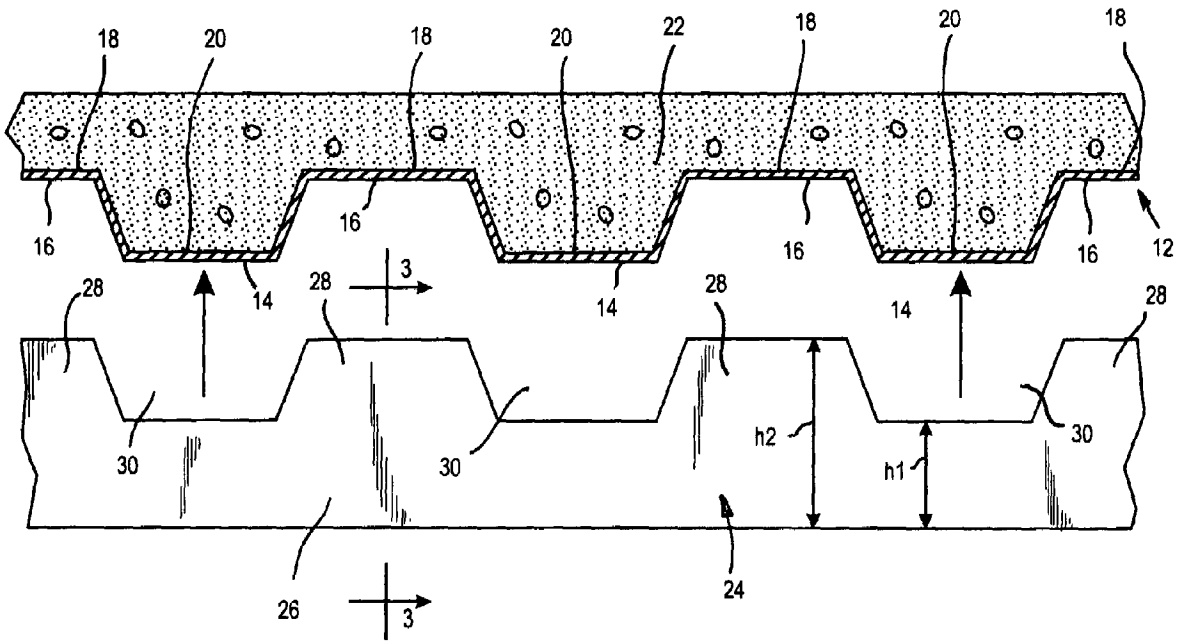
FIG. 2 is a fragmentary view showing a preformed wall panel incorporating the invention, spaced below a ceiling/floor.
Figure 3:
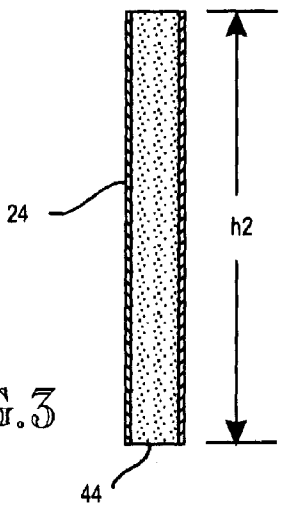
FIG. 3 is a sectional view taken substantially along line 3—3 of FIG. 2, showing the preformed wall panel in section.
Figure 4:
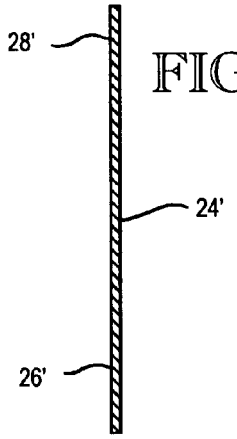
FIG. 4 is a view like FIG. 3, but showing a preformed wall panel in the form of a sheet metal member.
Figure 5:
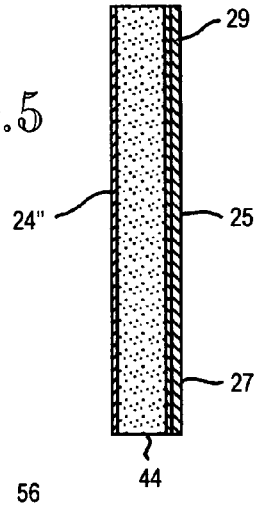
FIG. 5 is a view like FIG. 3, but showing a sheet metal backing strip bonded to a wall board member.
Figure 6:
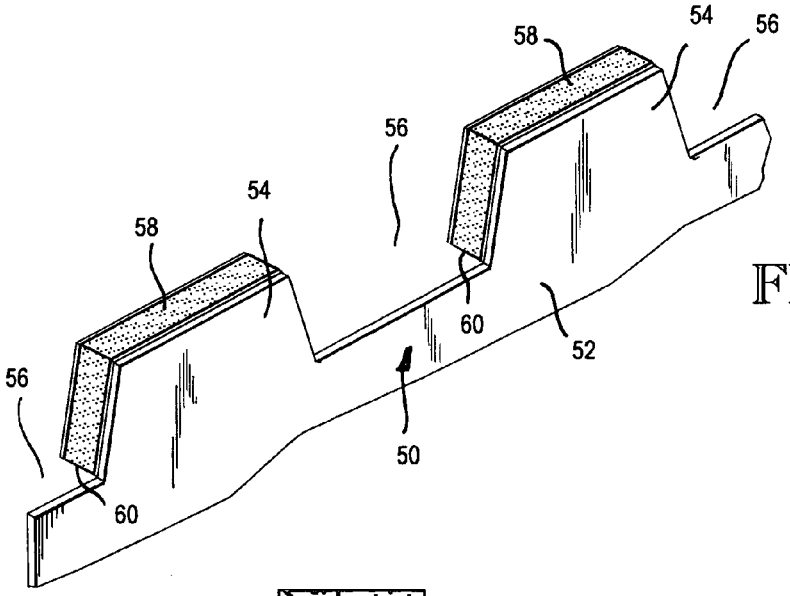
FIG. 6 is a pictorial view showing a sheet metal body and wallboard peak members bonded to peak portions of the sheet metal body.

Preformed panel member 24 may be cut from a piece of wallboard, such as shown in FIG. 1. The preformed panel 24' may be a sheet metal member 24' cut in the configuration of member 24, shown in FIGS. 1 and 2. That is, it has a continuous strip lower portion 26' and a series of upwardly projecting peak portions 28' spaced apart from each other and projecting upwardly from the strip portion 26'. Or, as shown by FIG. 5, preformed panel member 24" may be constructed from a wallboard member reinforced by a backing member (e.g. sheet metal member 25) that is also composed of a continuous lower portion 27 and peaks 29 projecting upwardly from the lower portion between valleys formed by and between the peaks. Or, as shown by FIG. 6, a sheet member reinforcing strip 25 conforming in size and shape to the member 24" may be bonded to the rear side of the member 24". The sheet metal reinforcing strip 25 may extend downwardly below the lower edge 44 to provide a larger sheet metal backing for the upper edge portion of the lower panel 48.

The preformed panel 50 may be formed from a piece of sheet metal 52 cut to form the peaks 54 and valleys 56 above a lower continuous strip portion 52. Wallboard members 58 having the shape of the peaks 54 are then bonded to the forward sides of the sheet metal peaks 54. The lower edges 60 of the wallboard peaks 58 are substantially co-linear. After the preformed panel member 50 is connected to the wall, wallboard panel 48 can be moved upwardly to place its upper edge 62 against the lower edges 60 of the wallboard peaks 58.

Member 24 may be constructed from a fibrous sheet material (fiberboard) to which a wallboard layer has been bonded. The fiberboard body may be about one-eighth of an inch thick and the wallboard covering may have a thickness that makes the preformed panel member 24 substantially equal in thickness to the wallboard panel 48.

Thus, the preformed panel member 24 may have a backing made of any material that can be bonded to the wallboard material and possess greater strength than the wallboard material. What is desirable is to be able to handle, place and fasten the panel 24 without it breaking apart.

Figure 7:
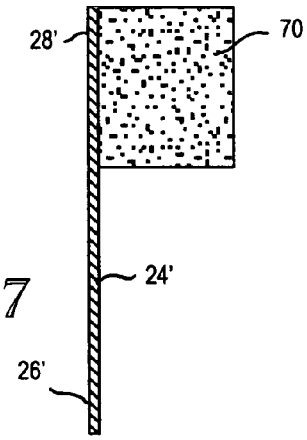
FIG. 7 is a view like FIG. 4, showing a body of insulation material secured to a peak of the sheet metal body.
Figure 8:
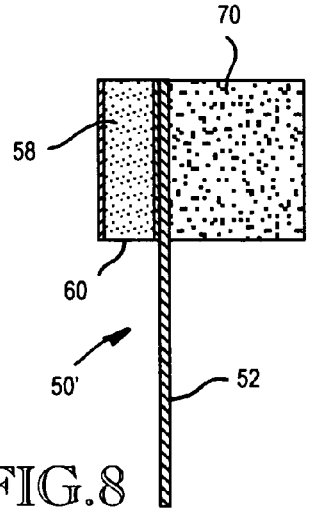
FIG. 8 is a view like FIGS. 3-5 and 7, showing wallboard members on the front side and insulation members on the rear side of the sheet metal member.

Additional embodiments of the invention are shown by FIGS. 7 and 8. FIG. 7 shows a preformed sheet metal body 24' that is constructed to in front elevation look like member 24 in FIG. 2. This embodiment is provided with bodies of insulation material 70 that are bonded to the rear sides of the peaks 54. The insulation material extends into the entrance portions of the tunnel openings formed by the channels 16. The material 70 may be a fireproof material and it may be a sound deadening material. The embodiment of FIG. 8 combines together the plasterboard front members 58 and the insulation rear members 70 on the sheet metal member 52. The insulation members 70 are placed into the tunnel openings 16 between the peaks 14 and the lower portion of sheet metal body 52 is placed against the flanges 36 of member 32. This moves the wallboard members 58 up into the channels 16. Wallboard 48 is then placed against the stud wall, with its upper edge 62 against the lower edges 60 of the wallboard members 58. The sheet metal member 52 is screwed to the front flange 38 of the track 32 and the front flanges of the studs 40.

The invention also comprises providing an installation tool for the preformed panel member 24. This tool may have a channel-shaped pocket into which the continuous lower portion 26 of the panel 24 can be placed. Then, the tool and the panel member 24 can be handled together, with the tool providing strength so that the panel member 24 will not break while being handled. Such a tool can be used for handling a panel member 24 that is made only from wallboard.

The dimensions h1, h2 are variables. They may be substantially larger than the dimensions that are illustrated. For example, dimension h1 may be about twenty-four inches (24") to about thirty-six inches (36"). Preformed wallboard panels in this size range can be easily lifted, placed and connected to the wall members 36, 40 without breaking under their own weight.

The illustrated embodiments are examples of the present invention, and, therefore, are non-limitive. It is to be understood that many changes in the particular structure, materials and features of the invention may be made without departing from the spirit and scope of the invention. Therefore, it is our intention that our patent rights not be limited by the particular embodiment that is illustrated and described herein, but rather is to be determined by the following claims, interpreted according to accepted doctrines of patent claim interpretation.

What is claimed is:

1. A building structure, comprising:

a horizontally extending upper channel member having a top web and first and second flanges connected to the top web, said flanges extending downwardly from the top web and forming with the top web a downwardly opening channel space;

a plurality of vertically extending studs, each said stud having a stud web and first and second stud flanges connected to the stud web;

said studs having upper end portions extending upwardly into the channel space of the upper channel member;

wherein the first flange of the upper channel member is in a first vertical plane and the first stud flange is in a second vertical plane which is contiguous the first vertical plane;

a sheet metal ceiling pan sifting down on the upper channel member, said sheet metal pan having sheet metal side and top panels forming downwardly opening channel spaces separated by upwardly opening channel spaces, said upwardly opening channel spaces having bottoms which are supported on and by the upper channel member; and a wall panel member having a base and peaks and valleys above the base, said base being positioned generally against the first flange of the upper channel member, and said peaks positioned in the downwardly directed channels of the sheet metal pan and having edges that are contiguous the side and top panels of the downwardly opening channels, and said bottom and side panels of the upwardly opening channels of the pan being positioned within the valleys of the wall panel member.

2. The building structure of claim 1, wherein the wall panel member is made of wallboard.

3. The building structure of claim 2, wherein the first flange of the upper channel member has a lower edge and the wallboard member has a lower edge that is about the lower edge of the first flange of the upper channel member.

4. The building structure of claim 1, wherein the wall panel member comprises a sheet metal body.

5. The building structure of claim 4, wherein the wall panel member also includes a wallboard bonded to the sheet metal body.

6. The building structure of claim 5, wherein the wallboard has a lower edge and the sheet metal body extends downwardly below the lower edge.

7. The building structure of claim 5, wherein the wallboard and the sheet metal body are both shaped to conform to the peaks and valleys of the wall panel member.

8. The building structure of claim 1, wherein the wall panel member has a body of installation attached to its peaks, said installation being adapted to extend into the downwardly opening channel of the sheet metal ceiling pan above the upper channel member.

9. The building structure of claim 2, comprising a second panel below the wall panel member, said second panel having an upper edge adjoining the lower edge of the wall panel member forwardly of the first flange of the upper channel member.

* * * * *